United States Patent [19]

Karliner et al.

[11] Patent Number: 4,583,876

[45] Date of Patent: Apr. 22, 1986

[54] PAINT ROLLER FEEDER

[75] Inventors: Rudolf R. Karliner, Minnetonka; Gerald E. Peterson, St. Paul, both of Minn.

[73] Assignee: Wagner Spray Tech Corporation, Minneapolis, Minn.

[21] Appl. No.: 602,206

[22] Filed: Apr. 19, 1984

[51] Int. Cl.[4] ..... B05C 17/02

[52] U.S. Cl. ..... 401/197; 401/208

[58] Field of Search ..... 401/197, 208

[56] References Cited

U.S. PATENT DOCUMENTS

| | | | |
|---|---|---|---|
| Re. 29,311 | 7/1977 | Ritter | 401/188 |
| 2,357,763 | 9/1944 | Pratt | 401/197 |
| 2,743,469 | 5/1956 | Ditch | 401/197 |
| 2,916,755 | 12/1959 | Bozzay | 401/197 |
| 2,955,310 | 10/1960 | Wichern | 15/128 |
| 2,965,911 | 12/1960 | Hempel et al. | 401/197 |
| 3,134,130 | 5/1964 | Chadwick, II | 15/552 |
| 3,145,411 | 8/1964 | Fischer et al. | 15/552 |
| 3,193,868 | 7/1965 | Cassidy | 15/553 |
| 3,310,831 | 3/1967 | Brinker | 15/575 |
| 3,549,267 | 12/1970 | Wurzer et al. | 401/147 |
| 3,554,659 | 1/1971 | Stokes | 401/197 |
| 3,809,484 | 5/1974 | Bradshaw | 401/185 |
| 3,826,581 | 7/1974 | Henderson | 401/197 |
| 4,175,300 | 11/1979 | McGlew et al. | 15/103.5 |
| 4,217,062 | 8/1980 | Trp et al. | 401/44 |

FOREIGN PATENT DOCUMENTS

| | | | |
|---|---|---|---|
| 822859 | 9/1969 | Canada | 401/197 |
| 899008 | 5/1972 | Canada | 401/197 |
| 1449554 | 7/1966 | France | 401/197 |
| 1415788 | 11/1975 | United Kingdom | 401/197 |

*Primary Examiner*—Steven A. Bratlie

*Attorney, Agent, or Firm*—Hill, Van Santen, Steadman & Simpson

[57] ABSTRACT

A paint roller assembly for a pressurized paint supply system including a hollow roller arm, a delivery tube within the roller arm for receiving pressurized coating material such as paint therethrough, the tube terminating in a horizontally disposed end portion, a circular flange mechanically coupled to the roller arm inwardly of the end portion to prevent relative rotation therebetween, an annular sealing member received over the end portion and arranged to abut the circular flange while permitting relative rotational movement therebetween, a cylindrical roller core having one end received on the end portion, the core having an axially extending relatively shallow groove at its periphery along a major portion of its length, the roller core being recessed at the discharge end of the end portion to provide a sump therein of greater depth than the groove and communicating with the groove. Distributor means are positioned in the groove and have spaced apertures therealong to permit paint to flow from the groove into a perforated paint roller cover positioned over the roller core.

8 Claims, 7 Drawing Figures

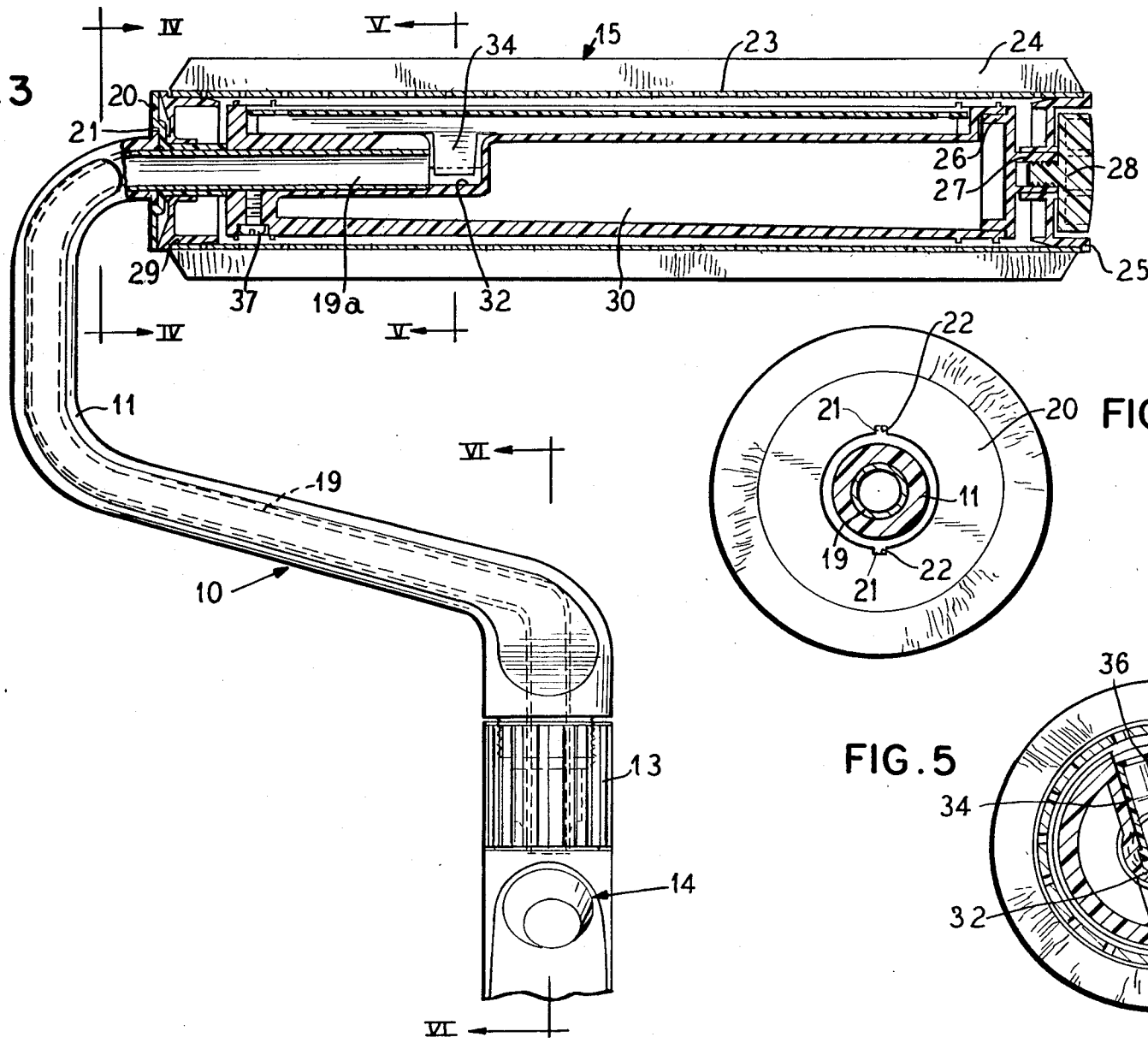
FIG. 3
FIG. 4
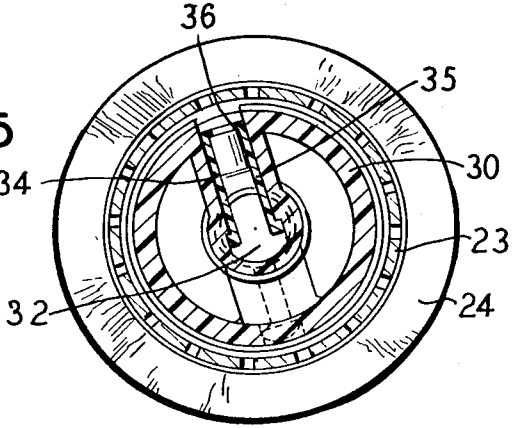
FIG. 5

PAINT ROLLER FEEDER

BACKGROUND OF THE INVENTION

1. Field of the Invention

This invention is in the field of pressurized systems for supplying paint or other coating material to a roller and includes a distribution system for uniformly delivering paint under pressure to the perforated paint roller cover.

2. Description of the Prior Art

Paint roller assemblies in which the paint is delivered under pressure from a container to the interior of a perforated roller cover have become increasingly popular in recent times. Such assemblies shorten painting time considerably. There have been some difficulties encountered, however, in securing uniform distribution of the paint to the roller cover and in preventing paint leaks at the extremities of the rotating cover.

SUMMARY OF THE INVENTION

The present invention provides a paint roller assembly for a pressurized paint supply system including a hollow roller arm which carries a delivery tube therein, the delivery tube being arranged to receive paint under pressure from a flexible hose connected to a compressor. The delivery tube extends beyond the roller arm and terminates in a horizontally disposed end portion. A circular flange is mechanically coupled to the roller arm inwardly of the end portion so as to prevent relative rotation therebetween. An annular sealing member is received over the end portion and is arranged to abut the circular flange while permitting relative rotational movement therebetween. A cylindrical roller core has one end received on the end portion and its opposite end received in an end cap. The cylindrical roller core has an axially extending, relatively shallow groove at its periphery along a major portion of its length. The roller core is recessed at the discharge end of the end portion of the delivery tube to provide a sump therein of greater depth than the groove, the sump communicating with the groove. Distributor means are positioned in the groove which have spaced apertures therealong to permit paint to flow from the groove into a perforated paint roller cover which is mounted for rotation about the axis of the roller core. The paint distributor may take the form of an apertured strip which is frictionally held within the groove. Locating means can be provided which couple the roller core to the delivery tube to position the groove at substantially the uppermost surface of the roller core so that the paint is delivered to the upper surface of the roller cover which results in a more uniform distribution of the paint. Improved sealing means are also provided at both ends of the roller core to prevent paint from finding its way beyond the extremities of the roller core cover.

BRIEF DESCRIPTION OF THE DRAWINGS

The present invention will be described more completely in conjunction with the attached sheets of drawings which illustrate a preferred embodiment thereof.

FIG. 3 is a view partly in elevation and partly in cross section of the roller arm and its interior construction;

FIG. 4 is a cross-sectional view taken substantially along the line IV—IV of FIG. 3;

FIG. 5 is a cross-sectional view taken substantially along the line V—V of FIG. 3;

DESCRIPTION OF THE PREFERRED EMBODIMENTS

Figure 1:
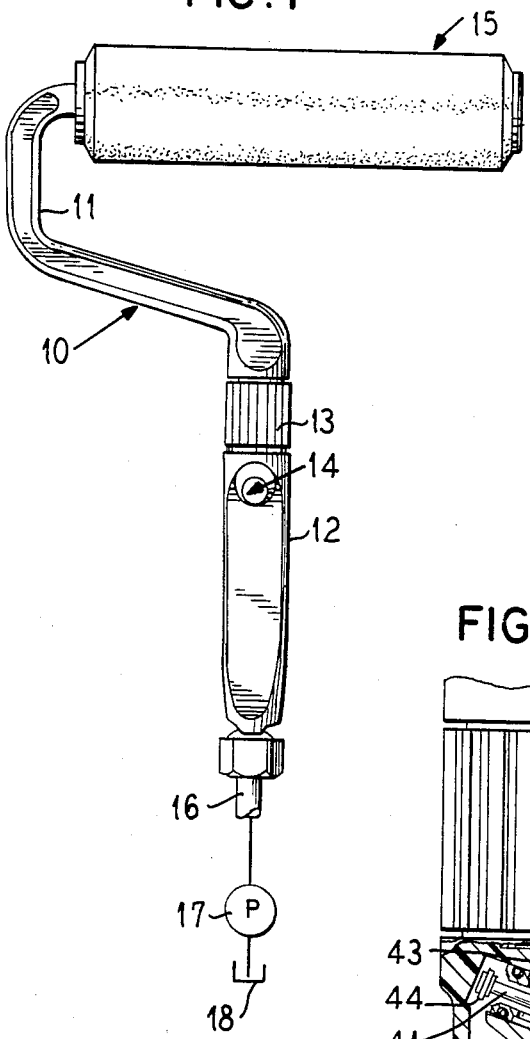
FIG. 1 is a view in elevation of the improved paint roller assembly of the present invention illustrating the overall system.
Figure 2:
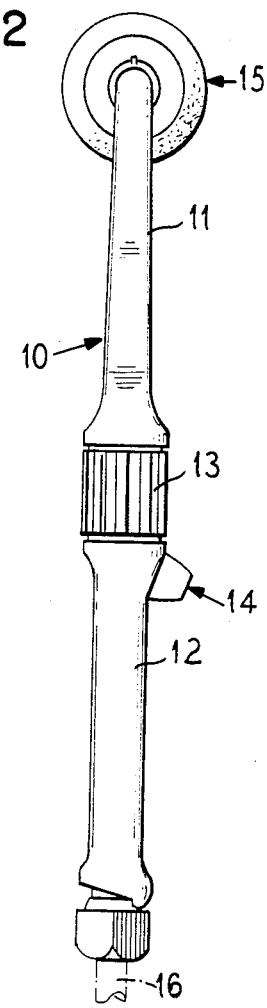
FIG. 2 is a side elevational view of the roller assembly shown in FIG. 1.

In FIG. 1, reference numeral 10 indicates generally a paint roller assembly according to the present invention which includes a hollow roller arm 11 and a roller handle 12 the two being connected by means of a cinch knob 13. A push-button operated valve assembly 14 is included in the handle 12 to control the flow of paint into the roller arm 11 and ultimately into a perforated paint roller cover 15. The paint is delivered to the roller assembly through a flexible hose 16 from a pump 17 which receives the paint from a reservoir schematically illustrated at reference numeral 18.

As best illustrated in FIG. 3, the hollow roller arm 11 carries a delivery tube 19 therein through which the paint is supplied to the paint roller. The delivery tube 19 extends through a circular flange 20. The handle has diametrically opposed keys 21 which are arranged to fit into slots 22 (FIG. 4) in the flange member 20 to prevent relative rotation therebetween.

Inwardly of the flange member 20 there is positioned an annular sealing member 29 which is received in slidable relation along the end of the roller arm 11. The annular sealing member 29 abuts the flange member 20 in sealing relation to prevent paint from finding its way out of the roller assembly. It also serves to support one end of the perforated roller cover 15 consisting of a perforated core 23 covered by an absorbent roller 24.

The opposite end of the perforated paint roller cover 15 is received against a flanged end portion of a rotary flange spacer 25 which is coaxial with an end cap 26. The end cap 26 has a hollow cylindrical axial extension 27 on which the rotary flange spacer 25 is rotatably mounted. The spacer 25 is internally recessed as indicated in FIG. 3 to receive a threaded locking member 28 which is received in threaded engagement in the extension 27 to prevent axial movement of the spacer 25.

As best seen in FIG. 3, the delivery tube 19 has a free end portion **19*a* which delivers paint into the interior of the roller assembly. A roller core 30 is mechanically fastened to the end portion 19*a* by means of a set screw 37. The interior of the roller core 30 is partitioned to define an axially extending, relatively shallow groove 31 at its periphery along a major portion of its length. The roller core 30 is recessed at the discharge end of the end portion 19*a* of the delivery tube to provide a sump 32 of greater depth than the depth of the groove 31**.

Figure 7:
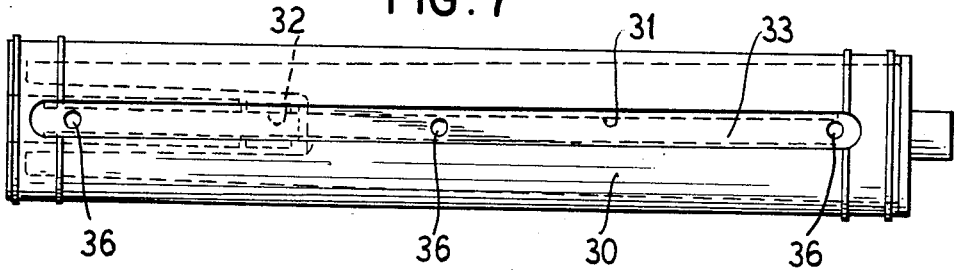
FIG. 7 is a plan view of the roller core and the distributor.

Positioned in the groove 31 is a distributor element consisting of a strip 33 having opposed ears 34 and 35 which are frictionally received along the vertical walls defining the groove 31. As best seen in FIG. 7, the strip 33 has spaced apertures 36 through which the paint exits from the groove 31 and through the perforated core 23 into the absorbent roller felt 24. The set screw 37 affixes the roller core such that the groove 31 is located substantially at the upper surface of the core. Consequently, paint existing through the apertures 36 is absorbed at the top of the roller cover 15 and then proceeds to the other portions of the cover by capillary action. In this way, the distribution of the paint to the roller cover is made more uniform than if the paint were discharged from the bottom of the roller core.

Figure 6:
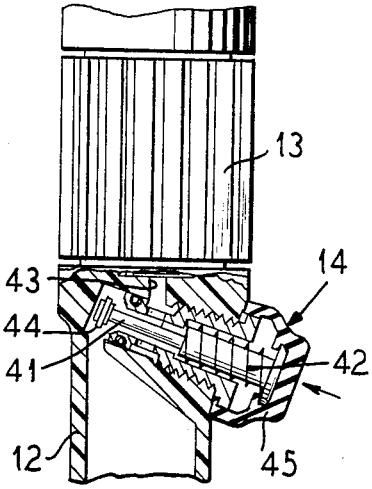
FIG. 6 is a fragmentary cross-sectional view of the valve assembly which controls delivery of the paint into the roller arm.

Control of the flow of paint into the roller is accomplished by means of the valve 14 best illustrated in FIG. 6 of the drawings. As shown, the valve is located in the handle 12 and includes a reciprocable valve element 41 operating against the bias of a spring 42. In FIG. 6, the valve is shown in its open position, thus permitting paint to flow about the valve element 41 into a discharge passageway 43. An O-ring 44 provides a seating surface for the valve element to close off the passage for paint when pressure on the element is released. A resilient cover 45 covers the valve element 41.

The paint roller assembly of the present invention provides an improved means for delivering paint from a pressurized supply to a rotatable roller cover. The paint is uniformly distributed to the interior of the roller cover, and leakage of paint is effectively prevented by the seals provided in the roller structure.

It should be evident that various modifications can be made to the described embodiments without departing from scope of the present invention.

We claim as our invention:

1. A paint roller assembly for a pressurized paint supply system comprising a hollow roller arm, a delivery tube within said roller arm for receiving pressurized paint therethrough, said tube extending beyond said roller arm and terminating in a horizontally disposed end portion, a circular flange mechanically coupled to said roller arm inwardly of said end portion to prevent relative rotation therebetween, an annular sealing member received over said end portion and arranged to abut said circular flange while permitting relative rotational movement therebetween, a cylindrical roller core having one end received on said end portion, said roller core having an axially extending relatively shallow groove at its periphery along a major portion of its length, said roller core being recessed at the discharge end of said end portion to provide a sump therein of greater depth than said groove and communicating with said groove, and distributor means positioned in said groove and having spaced apertures therealong to permit paint to flow from said groove through said apertures and into a perforated paint roller cover positioned along said roller core.

2. A paint roller assembly according to claim 1 wherein said distributor means comprises an apertured strip frictionally held within said groove.

3. A paint roller assembly according to claim 1 which includes means coupling said roller core to said delivery tube to position said groove at substantially the uppermost surface of said roller core.

4. A paint roller assembly according to claim 1 which includes a hollow roller handle, means releasably connecting said roller handle to said roller arm, a paint hose connected to said roller handle and arranged to deliver paint to said roller handle, and spring biased valve means in said roller handle controlling passage of paint through said roller handle.

5. A paint roller assembly according to claim 1 which includes an end cap sealing off the end of said roller core opposite from said one end and a rotary flanged spacer coaxial with said end cap and proportioned to receive one end of said perforated paint roller in frictional engagement for rotation therewith.

6. A paint roller assembly according to claim 5 in which said end cap has a hollow cylindrical axial extension with said spacer being received in rotatable relation on said extension.

7. A paint roller according to claim 6 which includes a threaded locking member received in threaded engagement in said extension to prevent axial movement of said spacer.

8. A paint roller according to claim 7 wherein said rotary flanged spacer is recessed to receive said threaded locking member.

* * * * *